US006367629B1

(12) United States Patent
Bautista et al.

(10) Patent No.: US 6,367,629 B1
(45) Date of Patent: Apr. 9, 2002

(54) FIBER MANAGEMENT PACKAGE

(75) Inventors: Kip T. Bautista, San Jose; David J. Haan, Sunnyvale; David H. Mordaunt, Los Alamitos, all of CA (US)

(73) Assignee: Lumenis Inc., Santa Clara, CA (US)

( * ) Notice: Subject to any disclaimer, the term of this patent is extended or adjusted under 35 U.S.C. 154(b) by 0 days.

(21) Appl. No.: 09/669,703

(22) Filed: Sep. 26, 2000

(51) Int. Cl.[7] ..... B65D 85/00

(52) U.S. Cl. ..... 206/388; 206/409; 206/438; 206/303

(58) Field of Search ..... 206/388, 383, 206/303, 702, 438, 363, 63.3, 380, 409

(56) References Cited

U.S. PATENT DOCUMENTS

| | | | | | |
|---|---|---|---|---|---|
| 3,972,418 | A | * | 8/1976 | Schuler et al. | 206/63.3 |
| 4,846,343 | A | | 7/1989 | Rupert | 206/303 |
| 4,974,789 | A | | 12/1990 | Milburn | 242/159 |
| 4,084,692 | A | * | 11/1993 | Bilweis | 206/403 |
| 5,407,071 | A | | 4/1995 | Lawhon et al. | 206/388 |
| 5,263,585 | A | * | 10/1996 | Lawhon et al. | 206/388 |
| 5,568,865 | A | * | 10/1996 | Mase | 206/438 |
| 5,848,691 | A | * | 12/1998 | Morris et al. | 206/364 |
| 5,941,430 | A | * | 8/1999 | Kuwabara | 223/109 R |

* cited by examiner

*Primary Examiner*—Paul T. Sewell
*Assistant Examiner*—Jila M. Mohandesi
(74) *Attorney, Agent, or Firm*—Eitan, Pearl, Latzer & Cohen-Zedek

(57) ABSTRACT

A package for storing a continuous length of optical fiber is formed from two mating portions. The mating portions are configured such that when joined they form an annular package including separate inside and outside concentric annular chambers. A circumferential slit around inside and outside edges of the annular package allows access to respectively the inside and outside chambers. Two fiber guides are provided, one engaging the inside edge and the other engaging the outside edge of the package. Each fiber guide is configured such that it can slide around the edge that it engages. An aperture in adjacent walls of the inner and outer chambers allows passage of an optical fiber from one to the other and also allows passage of fluids or gases for sterilization. The continuous length of optical fiber is stored in the optical package with one portion of the fiber coiled in the inside chamber and another portion coiled in the outside chamber, the stored portions being linked via the apertures in the chamber walls. One end of the optical fiber extends through the inner edge slit and through the inner edge fiber guide, the other end of extends through the outer edge slit and through the inner edge fiber guide. Optical fiber can be withdrawn from or replaced in either chamber by sliding the corresponding fiber guide away from or toward the end of the fiber extending therethrough.

11 Claims, 2 Drawing Sheets

FIBER MANAGEMENT PACKAGE

TECHNICAL FIELD OF THE INVENTION

The present invention relates in general to packages for storing optical fibers. The invention relates in particular to a sterilizable package for storing and dispensing optical fiber used for delivering laser energy from a laser to a treatment site in medical laser applications.

DISCUSSION OF BACKGROUND ART

In many applications of lasers in medical and surgical treatment, laser radiation is delivered from a laser via an optical fiber to a site being treated. Such treatment frequently involves an optical fiber penetrating a human body via an existing aperture or via an incision in the body to allow a site inside the body to be accessed. Examples of such treatments are in heart treatments, such as angioplasty and the like, and in transurethral treatment of prostate gland conditions.

An optical fiber used in such an application can have a length of up to 5 meters (m) or longer. Such an optical fiber is fragile and is difficult to store. Storage difficulty is due, among other factors, to a spring-like quality of the fiber which imparts a resistance to coiling the fiber. This requires that some means be provided for retaining the fiber in a coiled form.

A package for storing and dispensing such an optical fiber preferably protects the entire length of the fiber when the fiber is not in use, and protects an unused portion of the fiber when less than the entire length of the fiber is not in use. Preferably, it should be possible to withdraw the fiber from, or insert the fiber into, the package at both the end of the fiber that is connected to the laser and at the end of the fiber that delivers the radiation. Because of medical usage of the fiber, in particular in applications where body penetration is necessary, the optical fiber package and the optical fiber contained therein should be easily sterilizable.

SUMMARY OF THE INVENTION

The present invention is directed to a package for storing a continuous length of optical fiber. The package is configured for allowing the stored length of the optical fiber to be withdrawn from the package for use and replaced after use.

In one aspect, a package in accordance with the present invention includes two mating members. The mating members are configured such that, when joined, they form an annular package including separate inside and outside concentric annular chambers. A circumferential slit around inside and outside edges of the annular package allows access to respectively the inside and outside chambers. Two fiber-guides are provided, one engaging the inside edge and the other engaging the outside edge of the package. Each of the fiber guides is configured such that it can slide around the edge that it engages. An aperture in adjacent walls of the inner and outer chambers allows passage of the optical fiber from one chamber to the other. The continuous length of optical fiber is stored in the package with one portion of the fiber coiled in the inside chamber and another portion coiled in the outside chamber. The stored portions are linked via the apertures in the chamber walls. One end of the optical fiber extends through the inner-edge slit and through the inner-edge fiber-guide, the other end of extends through the outer-edge slit and the outer edge fiber-guide. In one preferred mode of operating the inventive package, optical fiber can be withdrawn from or replaced in either chamber by sliding the corresponding fiber guide away from or toward the end of the optical fiber extending therethrough.

In another aspect the chamber walls of the inventive package include a plurality of apertures arranged to allow circulation of one or more of fluids and gases in the chambers for sterilizing the chambers and the optical fiber stored therein. Preferably, the apertures are circumferentially and about equally spaced apart around the chamber walls.

In one preferred embodiment, the inventive package includes first and second annular mating members. Each of the mating members includes inner and outer concentric raised portions having a separating portion therebetween. The first and second raised portions are bounded on a side thereof opposite the separating portion by respectively an inner edge portion and an outer edge portion. The first and second mating members are fixedly joined at the separating portions thereof with corresponding ones of said edge portions in close proximity to each other such that the first and second raised portions form the inner and outer concentric chambers. The edge portions in close proximity form inner and outer edges of the package each having a slit extending completely therearound. The inner-edge and outer-edge slits allow access for the optical fiber to respectively the inner and outer chambers.

BRIEF DESCRIPTION OF THE DRAWINGS

The accompanying drawings, which are incorporated in and constitute a part of the specification, schematically illustrate a preferred embodiment of the present invention, and together with the general description given above and the detailed description of the preferred embodiment given below, serve to explain the principles of the invention.

DETAILED DESCRIPTION OF THE INVENTION

Figure 1:
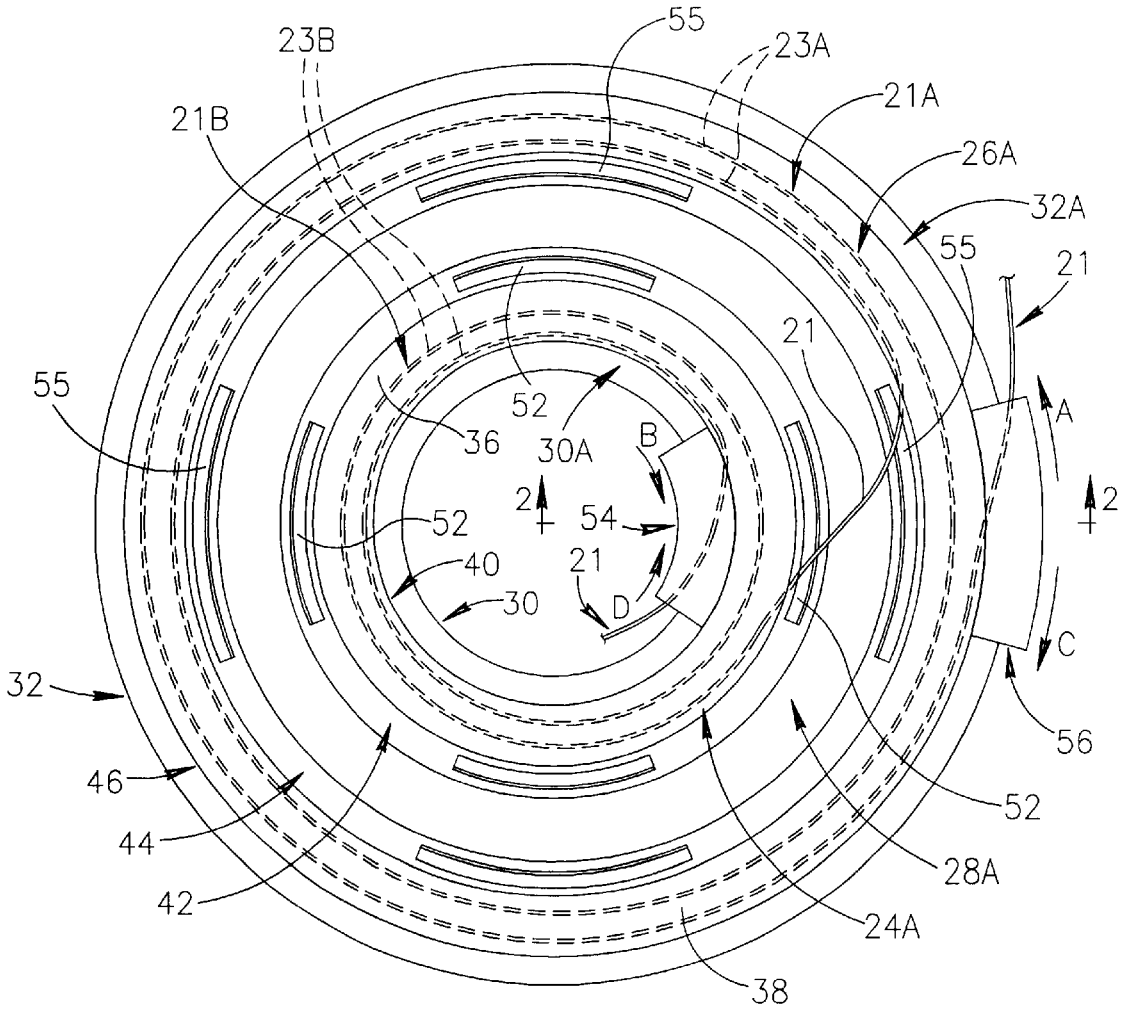
FIG. 1 is a plan view schematically illustrating one preferred embodiment of an optical fiber storage and dispensing package in accordance with the present invention.
Figure 2:
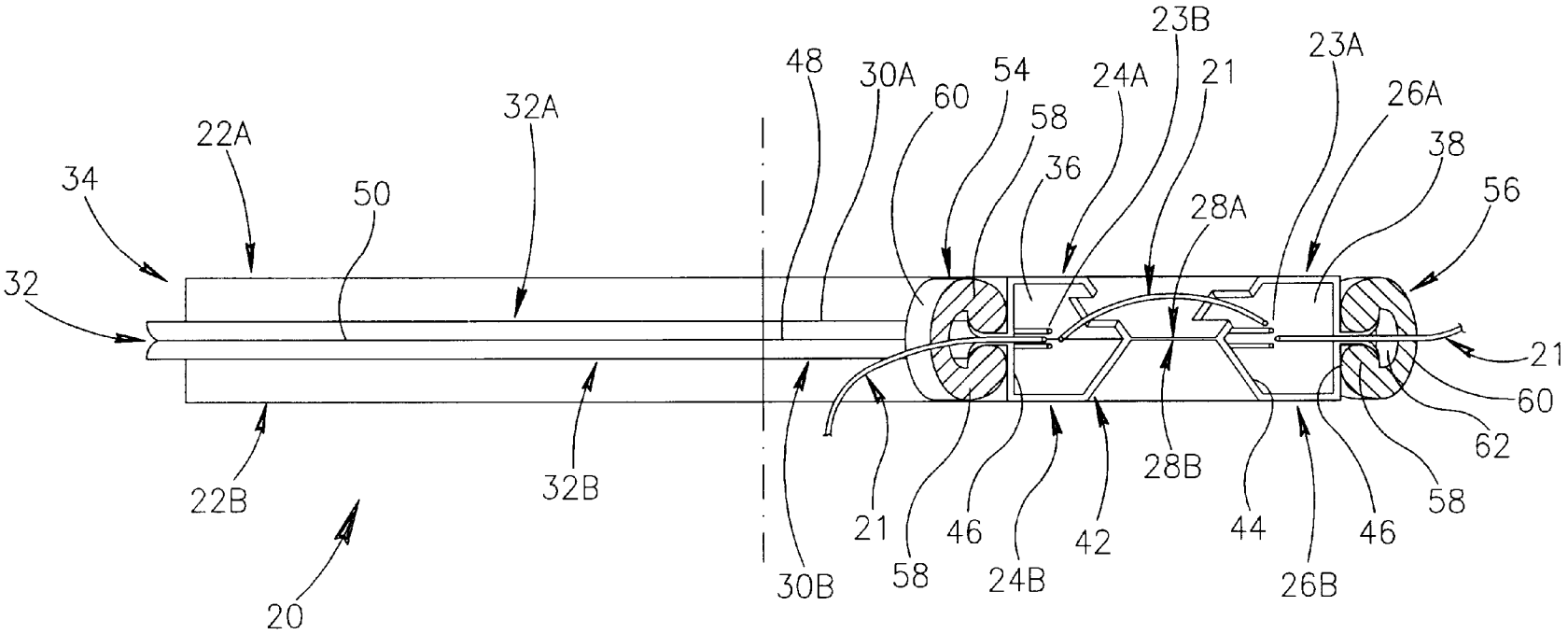
FIG. 2 is an elevation view, partly in cross section, schematically illustrating further details of the optical fiber storage and dispensing package of FIG. 1.

Turning now to the drawings, wherein like features are designated by like reference numerals, FIG. 1 and FIG. 2 schematically illustrate one preferred embodiment 20 of a optical fiber storage and dispensing package in accordance with the present invention. FIG. 2 is partially in cross-section, with the cross section portion thereof seen generally in the direction 2—2 of FIG. 1. Package 20 is arranged for storing and dispensing a continuous length 21 of optical fiber.

Package 20 includes two annular mating members 22A and 22B, preferably molded from a thermoplastic material. Whatever material is selected for forming the mating member, the material should preferably be sufficiently rigid that it will not deform without application of external force, but resilient enough that flexure of the material is possible with modest manual application of such external force. Further, the material is preferably selected such that the mating members will not undergo permanent deformation or a change of state when exposed to gases or solutions which may be used for sterilizing the package and optical fiber stored therein.

Mating member 22A has an inner concentric raised portion 24A and an outer concentric raised portion 26A, the raised portions having a separating portion 28A therebetween. Similarly mating member 22B has an inner concentric raised portion 24B and an outer concentric raised portion 26B having a separating portion 28B therebetween. Inner and outer concentric raised portions 24A and 26A are bounded on sides thereof opposite separating portion 28A by respectively inner and outer edge portions 30A and 32A. Similarly, inner and outer concentric raised portions 24B and 26B are bounded on sides thereof opposite separating portion 28B by respectively inner and outer edge portions 30B and 32B.

Mating members 22A and 22B are fixedly joined together by joining together separating portions 28A and 28B thereof. This may be accomplished by spot thermal welds, but is preferably accomplished by a continuous thermal bond which fuses the two separating portions together. Alternatively, the separating portions may be joined by an adhesive.

Inner edge portions 30A and 30B and outer edge portions 32A and 32B of the mating members are in close proximity with each other. The term "in close proximity", as used in this description and the appended claims, means in contact or separated by a distance less than the diameter of the smallest optical fiber 21 to be stored in package 20.

When mating members 22A and 22B are joined as described above, they form an annular unit 34 including inner and outer concentric annular chambers 36 and 38 respectively. The closely-proximate edge portions on mating members form respectively an inner edge 30 and an outer edge 32 of annular unit 34. Inner chamber 36 has an inward-facing wall 40 and an outward-facing wall 42. Outer chamber 38 has an inward-facing wall 44 and an outward-facing wall 46. Inner edges 30A and 30B of mating members 22A and 22B, being in close proximity as discussed above, form a circumferential slit 48 extending completely around inward-facing wall 40 and allowing access to chamber 36. Similarly, outer edges 32A and 32B of mating members 22A and 22B, form a circumferential slit 50 extending completely around outward facing wall 46 and allowing access to chamber 38. As noted above, the close proximity of the mating sides results in the slits 48 and 50 having a width at rest less than the diameter of the fiber. However, the material is selected to have sufficient resilience so that the fiber can be loaded into and withdrawn out of the chambers through the slits.

In outward-facing wall 42 of chamber 36 are a plurality of circumferentially-spaced-apart apertures 52. In inward facing wall 44 of chamber 38 are a plurality of circumferentially spaced apart apertures 55. Apertures 52 and 54 are depicted in FIGS. 1 and 2 as aligned with each other for reasons discussed in detail below. Alignment of the apertures, however, is not necessary.

Engaging inner and outer edges 30 and 32 of annular unit 34 are, respectively, inner and outer fiber-guides 54 and 56. Each of the fiber-guides has an arcuate shape which is arranged to match the radius of curvature of the edge that it engages. In a preferred engagement scheme depicted in FIGS. 1 and 2, engagement is effected by providing that edge portions 30A, 30B, 32A and 32B of mating members 22A and 22B are trough-shaped. Fiber-guides 54 and 56 have spaced-apart, curved portions 58 thereof arranged to fit into the trough-shaped edge portions. The fiber-guides are attached to the corresponding edges of annular unit 34 by snapping them into place thereon. The edges of the mating members are arranged to be sufficiently resilient to allow the snapping-in-place but sufficiently stiff that the fiber guides, once engaged, are retained in place. Dimensions and spacing of curved portions 58 of fiber guides 54 and 56 are arranged such that each fiber guide can slide completely around the edge that it engages. In each fiber-guide, edge-engaging curved portions 58 thereof are joined by an arcuate portion 60 forming an aperture or space 62 in the fiber-guide through which an optical-fiber can be passed.

In one preferred method for loading optical fiber 21, one end of the optical fiber is passed through aperture 62 in inner fiber-guide 54; through inner-edge slit 48 into inner chamber 36; through an aperture 52 in wall 42 of chamber 36; through an adjacent one of apertures 54 in wall 44 of chamber 38 into chamber 38; through outer-edge slit 50; and through aperture 62 in outer fiber-guide 56. This operation, of course, could be performed with steps thereof in the reverse order. Passage of the fiber-end through slits 48 and 50 can be facilitated by manually separating the adjacent edges of the mating members forming the slits against the natural resilience of the mating members. Optical fiber 21 is preferably arranged, following this operation, such that about-equal portions thereof are on opposite sides of the passage between apertures 52 and 54 and extending through fiber guides 54 and 56.

In one preferred method of storing optical fiber 21 in package 20, after the optical fiber has been arranged as described above, outer fiber-guide 56, is moved around outer edge 32 of unit 34 in the direction indicated in FIG. 1 by arrow A, i.e., in a direction toward the end of optical fiber 21 extending through fiber-guide 56. This motion of the fiber-guide urges the optical-fiber through slit 50, against the natural resilience of the material of mating portions 22A and 22B. Once urged through slit 50, the optical fiber is trapped inside chamber 38. This action causes a first portion 21A of optical fiber 21 to be stored in chamber 38 in the form of one or more loops 23A. Similarly, moving inner fiber-guide 54 around inner edge 30 of unit 34 in a direction indicated by arrow B (in a direction toward the end of optical fiber 21 extending through fiber-guide 54) urges optical-fiber 21 through slit 48 such that it becomes trapped in chamber 36. This action causes a second portion 21B of optical fiber 21 to be stored in chamber 36 in the form of one or more loops 23B.

Fiber-guide 56 can be moved in a direction indicated by arrow C (in a direction away the end of optical fiber 21 extending through fiber-guide 56) for dispensing optical fiber 21 from stored portion 21A thereof. This action urges stored optical fiber out of chamber 38 through slit 50 and pays-out the fiber through the fiber-guide away from the direction of motion thereof. Similarly, fiber-guide 54 can be moved in a direction indicated by arrow D for dispensing optical fiber 21 from stored portion 21A thereof. This action urges stored optical fiber out of chamber 36, through slit 48, and pays-out the fiber through fiber-guide 54 away from the direction of motion thereof. Fiber may also be payed out by gripping a fiber-guide and pulling fiber though the guide while allowing the package to rotate through the guide.

Apertures 52 and 54 in walls 42 and 44 respectively, as depicted in FIGS. 1 and 2 are provided for allowing sterilizing fluids or gases to enter chambers 36 and 38 for sterilizing the chambers and optical fiber stored therein. As such, the apertures are sized sufficient primarily to facilitate fluid or gas flow. Conveniently, adjacent ones of apertures 52 and 54 provide access for optical fiber 21 between chambers 36 and 38. Those skilled in the art will recognize, however, without further illustration, that it is also possible to provide at least one smaller aperture in each of walls 42 and 44 (with the apertures appropriately aligned) for providing access for optical fiber 21 between chambers 36 and 38.

In summary, an inventive package for storing optical fiber is described above. The package is annular and includes inside and outside concentric annular chambers for storing the optical fiber. The optical fiber is stored in the optical package with one portion thereof coiled in the inside chamber and another portion thereof coiled in the outside chamber, the stored portions being linked via the apertures in the chamber walls. A slit around each of the inner and outer edges of the package allows access for the optical fiber to respectively the inner and outer chambers. Inner and outer fiber guides slidably engage respectively the inner and outer edges of the package. One end of the optical fiber extends through the inner edge slit and through the inner edge fiber-guide. The other end of the optical-fiber extends through the outer edge slit and through the outer edge fiber-guide. Optical fiber can be withdrawn from or replaced in either chamber by sliding the corresponding fiber guide away from or toward the end of the fiber extending therethrough.

The present invention is described above in terms of a preferred and other embodiments. The invention is not limited, however, to the embodiments described and depicted. Rather, the invention is limited only by the claims appended hereto.

What is claimed is:

1. A package for storing a continuous length of optical fiber, comprising:

two mating members, said mating members being joined to form an annular unit having radially inside and outside edges and including separate inside and outside concentric annular chambers;

said annular unit having first and second circumferential slits extending completely around respectively said inside and outside edges thereof, said first and second slits allowing access for the length of optical fiber to respectively said inside and outside chambers;

first and second fiber guides for guiding the optical fiber into and out of respectively said first and second slits, said first and second fiber guides engaging respectively said inside and outside edges of said annular unit and each of said fiber guides being configured to slide around the edge associated therewith;

said inside and outside chambers having walls thereof facing each other and each including at least a first aperture, said first apertures being arranged to allow passage of an optical fiber from one said chamber to the other, wherein, the continuous length of optical fiber is stored in the optical package with one portion thereof coiled in said inside chamber and another portion thereof coiled in said outside chamber, said stored portions being linked via said apertures in the chamber walls, and wherein first and second opposite ends of the stored optical fiber can be withdrawn through respectively said first slit and said first fiber guide and said second slit and said second fiber-guide.

2. The package of claim 1, wherein said mating members and said fiber-guides are arranged such that optical fiber can be withdrawn from or replaced into either chamber by sliding the corresponding said fiber-guide away from or toward the end of the optical fiber extending therethrough.

3. The package of claim 1, wherein said chamber walls include a plurality of apertures arranged to allow circulation of one or more of fluids and gases in said chambers for sterilizing said chambers and the optical fiber stored therein.

4. The package of claim 3, wherein said apertures are circumferentially spaced apart around said chamber walls.

5. A package for storing and dispensing a continuous length of optical fiber, comprising:

first and second generally annular mating members each thereof including radially inner and outer concentric raised portions having a separating portion therebetween, said first and second raised portions being bounded on a side thereof opposite said separating portion by respectively an inner edge portion and an outer edge portion;

said first and second mating members being fixedly joined at said separating portions thereof with corresponding ones said edge portions in close proximity to each other, such that said mating members form an annular unit having an inside edge and an outside edge, with said first and second raised portions of said mating members forming inner and outer concentric chambers in said annular unit, each thereof having an inward-facing wall and an outer outward-facing wall, said inward-facing wall of said outer chamber and said outward-facing wall of said inner chamber each having at least one aperture therein, and said closely-proximate edge portions defining said inner and outer edges of said annular unit and defining first and second slits extending around respectively said inner and outer edges of said annular unit for providing access for the optical fiber to respectively said inner and outer chambers;

inner and outer fiber-guides slidably engaging respectively said inner and outer edges of said annular unit, each of said fiber-guides arranged to allow passage of the optical fiber therethrough; and wherein, the continuous length of optical fiber is stored with a first portion thereof in a first coil in said inner chamber and with a second portion thereof in a second coil in said outer chamber, said optical fiber extending from said inner chamber to said outer chamber via said at least one aperture in said walls thereof, and with a first end of the optical fiber extending from said inner chamber through said inner-edge slit and through said inner fiber guide, and a second end of the optical fiber extending from said second chamber through said outer-edge slit and through said outer fiber guide.

6. The package of claim 5, wherein at least a portion of said first portion of the continuous fiber can be withdrawn from said first coil by sliding said inner fiber-guide around said inner edge of said annular unit in a direction away from said first end of said optical fiber, and said withdrawn fiber can be replaced in said first coil by sliding said first fiber guide around said inner edge of said annular unit in a direction toward said first end of said optical fiber.

7. The package of claim 6, wherein at least a portion of said second portion of the continuous fiber can be withdrawn from said second coil by sliding said outer fiber-guide around said outer edge of said annular unit in a direction away from said second end of said optical fiber, and said withdrawn fiber can be replaced in said second coil by sliding said second fiber guide around said outer edge of said annular unit in a direction toward said second end of said optical fiber.

8. The package of claim 5, wherein said closely-proximate edge portions of said mating members are separated at a closest point by a distance less than the diameter of the optical fiber.

9. The package of claim 8, wherein said first and second mating members are formed from a material sufficiently resilient that said closely-proximate edge portions thereof can be urged apart to allow passage of the optical fiber through said first and second slits.

10. The package of claim 8, wherein said closely-proximate edge at a closest point to each other are in contact.

11. The package of claim 10, wherein said first and second mating members are formed from a material sufficiently resilient that said closely-proximate edge portions thereof can be urged apart to allow passage of the optical fiber through said first and second slits.

* * * * *